US007543734B2

(12) United States Patent
Wang

(10) Patent No.: US 7,543,734 B2
(45) Date of Patent: Jun. 9, 2009

(54) PACKING BOX

(75) Inventor: Li-Song Wang, Foshan (CN)

(73) Assignees: Premier Image Technology (China) Ltd., Foshan, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/033,227

(22) Filed: Feb. 19, 2008

(65) Prior Publication Data

US 2009/0121002 A1 May 14, 2009

(30) Foreign Application Priority Data

Nov. 14, 2007 (CN) ..... 2007 1 0202531

(51) Int. Cl.
*B65D 5/483* (2006.01)

(52) U.S. Cl. ..... 229/120.17; 229/120.04; 229/127; 229/185

(58) Field of Classification Search ..... 229/120.04, 229/120.17, 120, 120.05, 120.18, 127, 143, 229/185
See application file for complete search history.

(56) References Cited

U.S. PATENT DOCUMENTS 1,881,900 A * 10/1932 Oman et al. ..... 229/120.17
2,515,151 A * 7/1950 Crane ..... 229/120.17
2,693,309 A * 11/1954 Giroux et al. ..... 229/120.04
2,721,001 A * 10/1955 Hasselhoff ..... 229/120.17
2,830,697 A * 4/1958 Paige ..... 229/120.17
3,226,007 A * 12/1965 Thies et al. ..... 229/127
4,091,926 A * 5/1978 Cravens ..... 229/120.17
4,194,679 A * 3/1980 Lohrbach et al. ..... 229/185
4,214,696 A * 7/1980 Barton et al. ..... 229/127
4,347,967 A * 9/1982 Loudermilk, Jr. ..... 229/120.17
4,396,145 A * 8/1983 Ditton ..... 229/120.17
4,467,923 A * 8/1984 Dornbusch et al. ..... 229/120.04
4,574,996 A * 3/1986 Brian ..... 229/120.17
4,944,405 A * 7/1990 Buford et al. ..... 229/120.04
5,325,602 A * 7/1994 Nainis et al. ..... 229/120
7,255,262 B2 * 8/2007 Duyst ..... 229/120.17

* cited by examiner

*Primary Examiner*—Gary E Elkins
(74) *Attorney, Agent, or Firm*—Zhigang Ma

(57) ABSTRACT

An exemplary box includes four sidewalls, four covers, two inner flaps, and two out flaps. The sidewalls are continuously connected together end by end and enclose a chamber therein. The covers extend from top edges of the sidewalls respectively for covering the chamber. The flaps extend from bottom edges of the sidewalls respectively. The inner flaps form two engaging flanges respectively extending from free edges thereof into the chamber and define engaging grooves therein. The outer flaps form engaging flanges respectively extending from free edges thereof into the chamber and define engaging cutouts in the engaging flanges respectively. The engaging flanges of the outer flaps are inserted into the engaging grooves of the inner flaps and snap the engaging flanges of the inner flaps in the engaging cutouts. The engaging flanges of the inner and outer flaps thereby divide the chamber into several compartments.

12 Claims, 5 Drawing Sheets

PACKING BOX

BACKGROUND

1. Technical Field

The present invention relates to a packing structure and, particularly, to a box for accommodating several components therein.

2. Description of Related Art

Current electronic devices generally comprise several attachments which are packaged within a box together with the electronic device. If the electronic device as well as the attachments is placed into the box without any partitions, they may become disordered. For dividing the box into several compartments to receive different components of the electronic device, a perforated cushion is employed. However, the cushion and the box are separately manufactured, which is time consuming and costly.

What is needed, therefore, is a integrally partitioned box able to receive different components.

SUMMARY

Accordingly, a box includes four sidewalls, four covers, two inner flaps, and two outer flaps. The sidewalls are continuously connected together end by end and enclose a chamber therein. The covers extend from top edges of the sidewalls respectively for covering the chamber. The flaps extend from bottom edges of the sidewalls respectively. The inner flaps form two engaging flanges respectively extending from free edges thereof into the chamber and define engaging grooves therein. The outer flaps form engaging flanges respectively extending from free edges thereof into the chamber and define engaging cutouts in the engaging flanges respectively. The engaging flanges of the outer flaps are inserted into the engaging grooves of the inner flaps and snap the engaging flanges of the inner flaps in the engaging cutouts. The engaging flanges of the inner and outer flaps thereby divide the chamber into several compartments.

Other advantages and novel features will be drawn from the following detailed description of at least one embodiment, when considered in conjunction with the attached drawings.

DETAILED DESCRIPTION OF THE EMBODIMENTS

Figure 1:
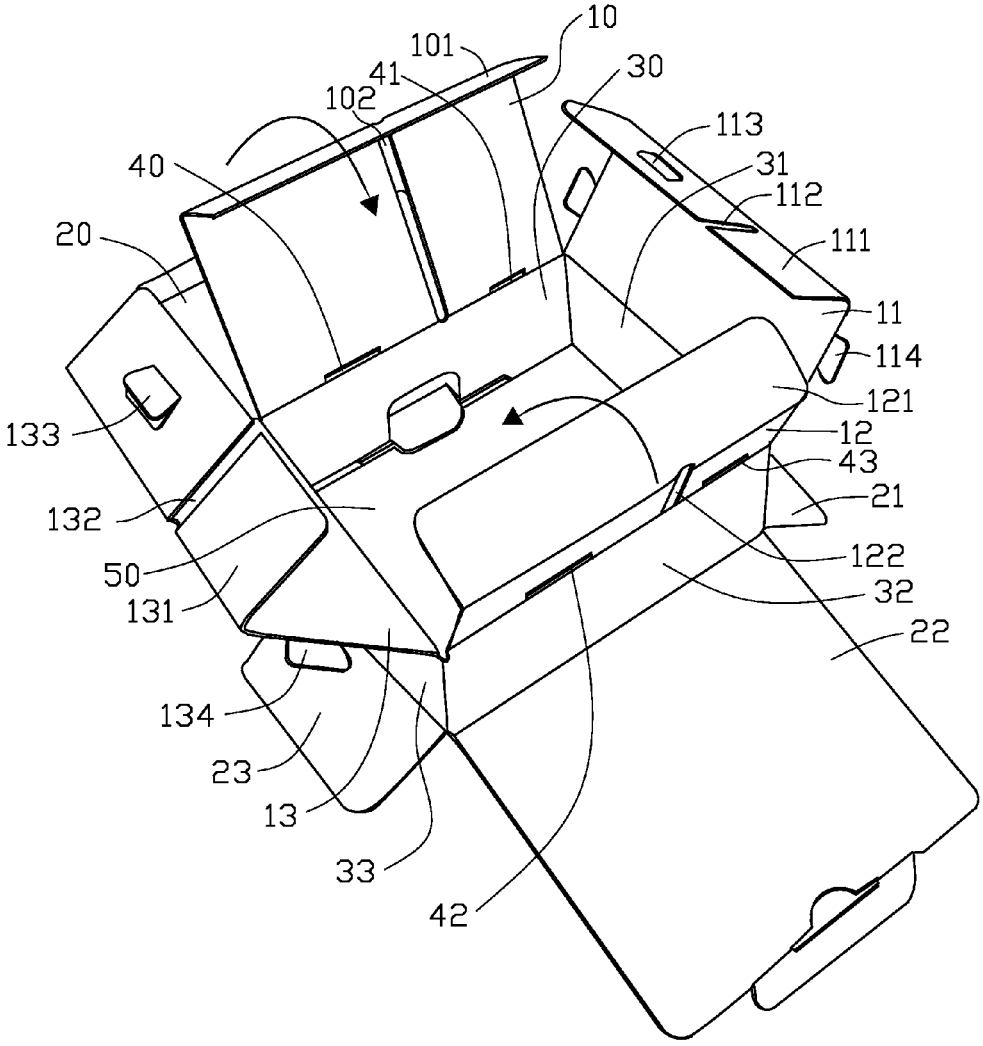
FIG. 1 is an isometric view of a box according to a present embodiment, without being folded.

Embodiments of the present box will be described in detail below with reference to the drawings.

Referring to FIGS. 1-5, a box according to a present embodiment comprises four flaps 10~13, four covers 20~23, and four sidewalls 30~33. The four sidewalls 30~33 are connected end to end to enclose an interior chamber 50. The flaps 10, 12 are inner flaps and extend from two parallel bottom edges of the sidewalls 30, 32 respectively. The flaps 11, 13 are outer flaps and extend from another two parallel bottom edges of the sidewalls 31, 33. The inner flaps 10, 12 form engaging flanges 101, 121 respectively perpendicularly extending from free edges thereof into the chamber 50, and define engaging grooves 102, 122 therein. In the embodiment, the engaging grooves 102, 122 are aligned with each other. The outer flaps 11, 13 form engaging flanges 111, 131 respectively perpendicularly extending from free edges thereof into the chamber 50, and define engaging cutouts 112, 132 in the engaging flanges 111, 131 thereof. The outer flaps 11, 13 are interlocked with the inner flaps 10, 12, via insertion of the engaging flanges 111, 113 of the outer flaps 11, 13 into the first engaging grooves 102, 122 and snappingly engaging the flanges 101, 121 of the inner flaps 10, 12 in the engaging cutouts 112, 132. The covers 20~23 extend from top edges of the sidewalls 30~33 and can be locked together as illustrated in FIGS. 1-5 or by any conventional means for covering the chamber 50.

Figure 2:
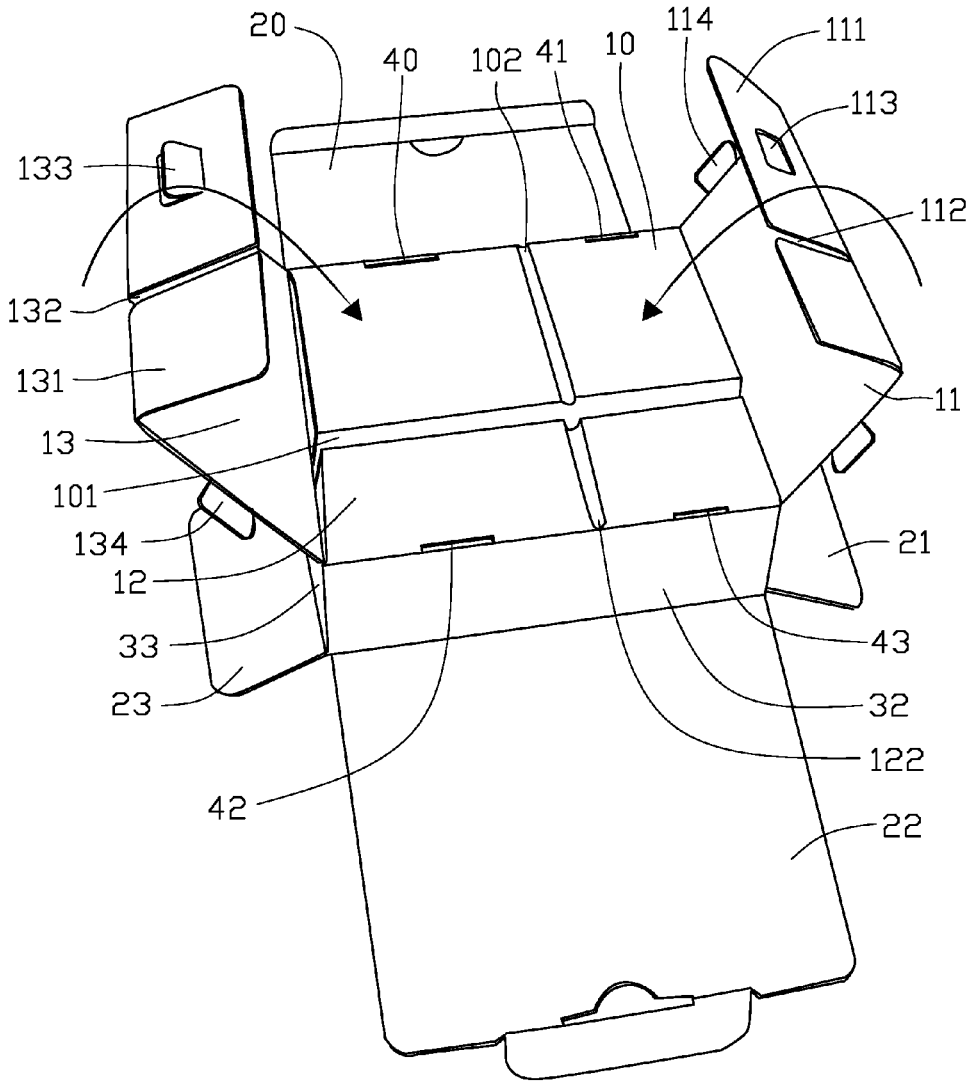
FIG. 2 is an isometric view of the box of FIG. 1 which is partially folded.

Referring to FIGS. 1-2, the engaging groove 102 extends through the inner flap 10 from the sidewall 30 to the engaging flange 101, in a direction perpendicular to the bottom edge of the sidewall 30. Two separate slots 40, 41 are defined in the inner flap 10, extending along the bottom edge of the sidewall 30. The slots 40, 41 adjoin the bottom edge of the sidewall 30 and are disposed at opposite sides of the engaging groove 102. The engaging groove 122 extends through the inner flap 12 from the sidewall 32 to the engaging flange 121, in a direction perpendicular to the bottom edge of the sidewall 32. Two separate slots 42, 43 are defined in the inner flap 12, extending along the bottom edge of the sidewall 32. The slots 42, 43 adjoin the bottom edge of the sidewall 32 and are disposed at opposite sides of the engaging groove 122.

Two tabs 114 are formed on opposite lateral edges of the outer flap 11. The tabs 114 are receivable in the adjacent slots 41, 43. The engaging cutout 112 divides the engaging flange 111 into two pieces, which pass through the engaging grooves 102, 122 respectively. A mouth 113 is defined in one of the pieces of the engaging flange 111. Two tabs 134 are formed on opposite lateral edges of the outer flap 13. The tabs 134 are receivable in the adjacent slots 40, 42. The engaging cutout 132 divides the engaging flange 131 into two pieces, which pass through the engaging grooves 102, 122 respectively. A tongue 133 is formed at one of the pieces of the engaging flange 131, and is extendable into the mouth 113 of the engaging flange 111.

Figure 3:
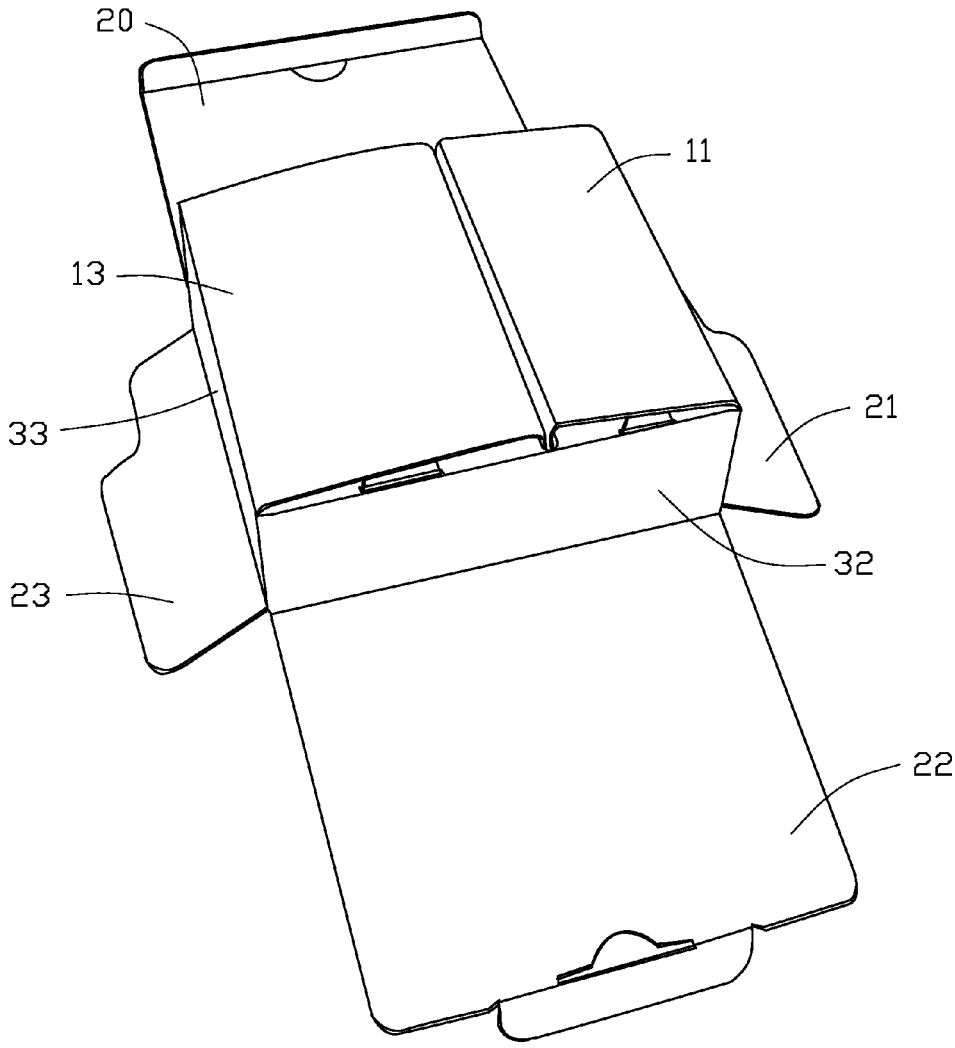
FIG. 3 is similar to FIG. 2, but the box is further folded.
Figure 4:
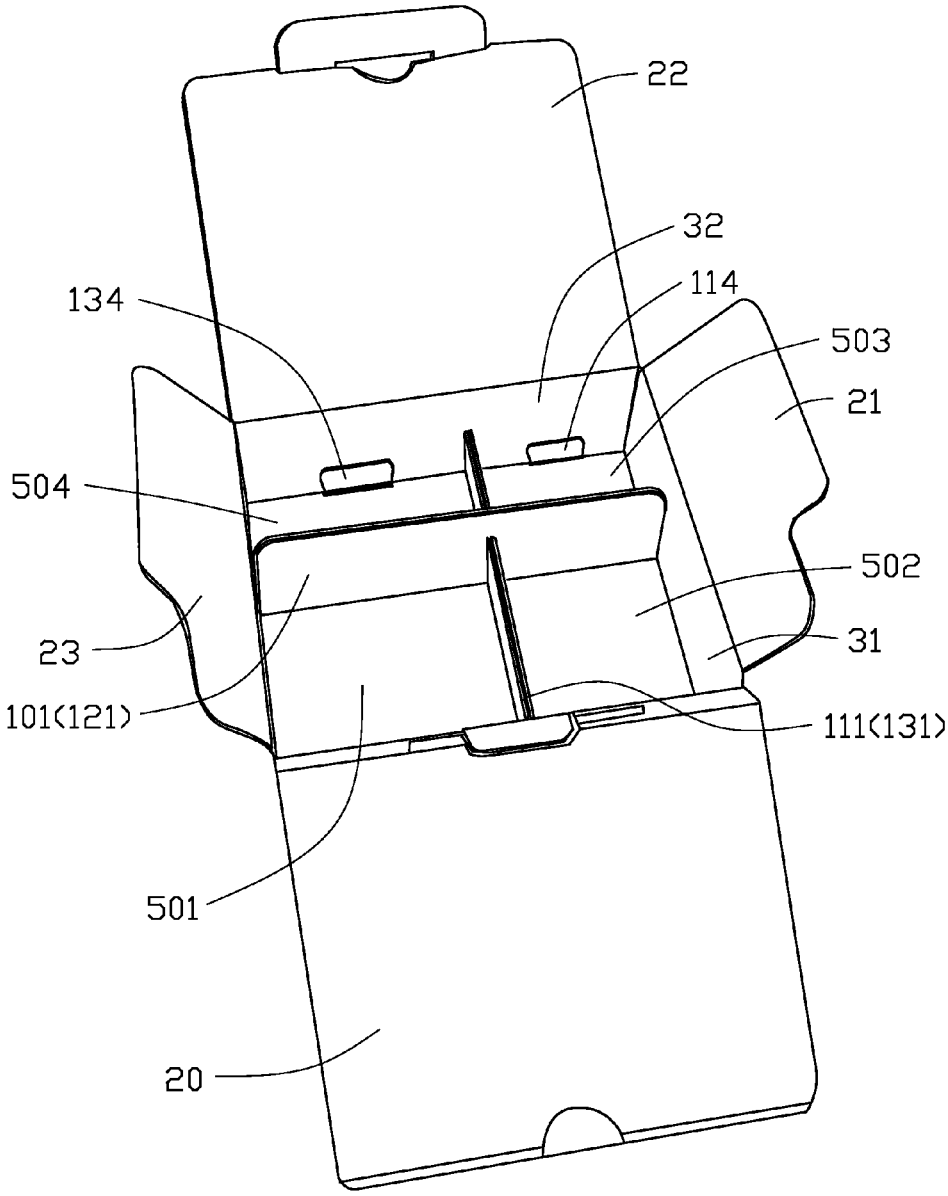
FIG. 4 is an up-side-down view of FIG. 3.
Figure 5:
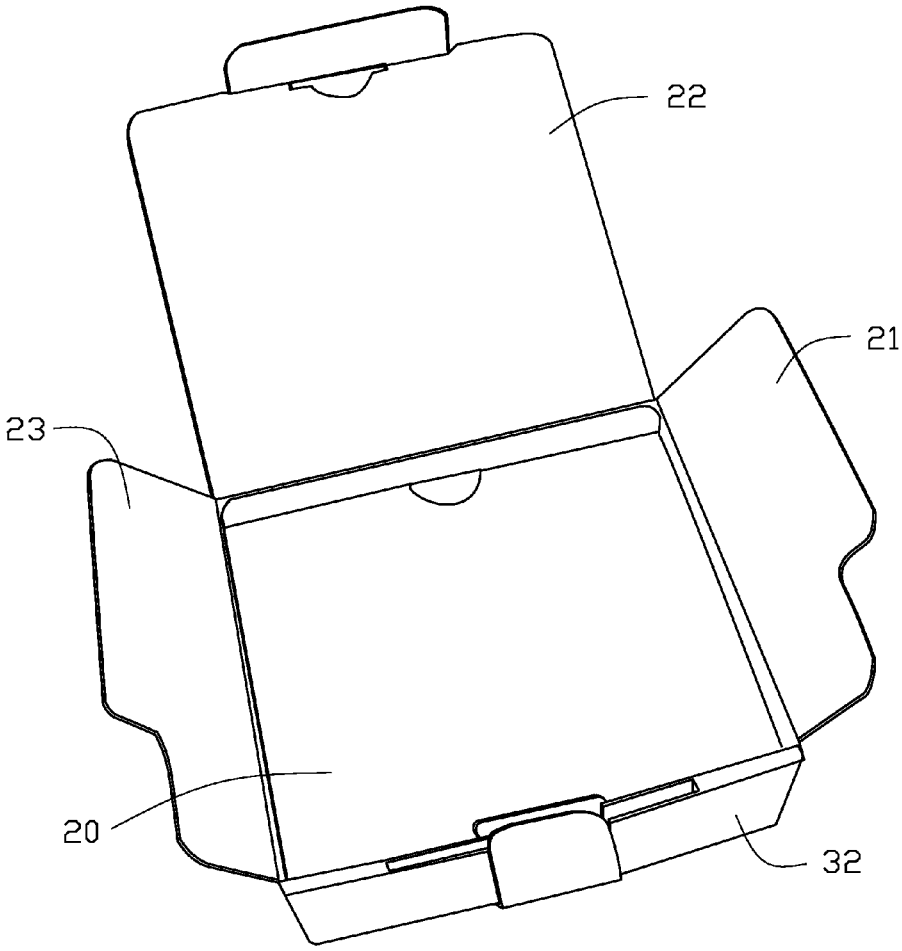
FIG. 5 is similar to FIG. 4, but the box is further folded.

Referring to FIGS. 2-4, for folding the flaps 10~13 together, the inner flaps 10, 12 are folded inwardly to be perpendicular to the sidewalls 30~33. The engaging flanges 101, 121 face each other and extend into the chamber 50 of the box. The interior chamber 50 in the box is thus divided into two parts by the engaging flanges 101, 121. Then, the outer flaps 11, 13 are folded to abut against outer surfaces of the inner flaps 10, 12. The engaging flanges 111, 131 are inserted into the engaging grooves 102, 122 respectively and snappingly engage the flanges 101, 121 in the engaging cutouts 112, 132. The engaging flanges 111, 131 extend into the chamber 50 of the box. Thus, the outer flaps 11, 13 are interlocked with the inner flaps 10, 12, and the chamber 50 is divided into four compartments 501~504 by the engaging flanges 101~131. As a result, the box is capable of orderly accommodating four components therein.

It is understood that sizes of the compartments 501~504 can be modified by changing locations of the engaging grooves 102, 122 and the engaging cutouts 112, 132, according to dimensions of the electronic device and the attachments. It is also understood that the inner flaps 10, 12 can each define more than one engaging groove therein, and the outer flaps 11, 13 can each define more than one engaging cutout therein. For example, two engaging grooves 102, 122 are defined in each inner flaps 10, 12. The engaging flange 112 is inserted into one of the engaging grooves 102 and one of the engaging grooves 122, and the engaging flange 132 is inserted into the other engaging groove 102 and the other engaging groove 122.

Referring to FIGS. 1-5, in the embodiment, after the electronic device and the attachments are placed into the compartments 501~504, the cover 20 is folded to cover the electronic device and the attachments, the covers 21, 23 are then folded to abut against the cover 20, and finally the cover 22 is folded and locked to the sidewall 32. Thus, the electronic device and the attachments are orderly packed in the box.

It will be understood that the above particular embodiments and methods are shown and described by way of illustration only. The principles and features of the present invention may be employed in various and numerous embodiments thereof without departing from the scope of the invention as claimed. The above-described embodiments illustrate the scope of the invention but do not restrict the scope of the invention.

What is claimed is:

1. A box comprising:

four sidewalls continuously connected together end by end and enclosing a chamber therein, four covers extending from top edges of the sidewalls respectively for covering the chamber; and two inner flaps and two outer flaps extending from bottom edges of the sidewalls respectively, each inner flap forming an engaging flange extending from an edge thereof into the chamber and defining an engaging groove in the inner flap, two separate slots being defined in each inner flap and extending along the bottom edge of the corresponding sidewall, each outer flap forming an engaging flange extending from an edge thereof into the chamber and defining an engaging cutout in the engaging flange thereof, two tabs being formed on opposite lateral edges of each outer flap and being received into the adjacent slots, the engaging flanges of the outer flaps being inserted into the engaging grooves of the inner flaps and snapping the engaging flanges of the inner flaps in the engaging cutouts, the engaging flanges of the inner and outer flaps thereby dividing the chamber into several compartments.

2. The box as claimed in claim 1, wherein each engaging cutout divides the corresponding outer flap into two pieces which are respectively inserted into the engaging grooves of the inner flaps.

3. The box as claimed in claim 1, wherein a mouth is defined in one of the engaging flanges of the outer flaps, and a tongue is formed on another engaging flange of the outer flaps and extended into the mouth.

4. The box as claimed in claim 1, wherein the engaging grooves of the inner flaps are aligned with each other.

5. The box as claimed in claim 1, wherein the slots adjoin the bottom edge of the corresponding sidewall and are disposed at opposite sides of the corresponding engaging groove.

6. A box comprising:

four sidewalls continuously connected together end by end and enclosing a chamber therein;

four covers extending from top edges of the sidewalls respectively for covering the chamber; and two inner flaps and two outer flaps extending from bottom edges of the sidewalls respectively, each inner flap forming an engaging flange extending from an edge thereof into the chamber and defining an engaging groove in the inner flap, each outer flap forming an engaging flange extending from an edge thereof into the chamber and defining an engaging cutout in the engaging flange thereof, a mouth being defined in one of the engaging flanges of the outer flaps, a tongue being formed on another engaging flange of the outer flaps and extended into the mouth, the engaging flanges of the outer flaps being inserted into the engaging grooves of the inner flaps and snapping the engaging flanges of the inner flaps in the engaging cutouts, the engaging flanges of the inner and outer flaps thereby dividing the chamber into several compartments.

7. The box as claimed in claim 6, wherein the engaging grooves extend through the inner flaps from the sidewalls to the engaging flanges respectively, in a direction perpendicular to the bottom edges of the sidewalls.

8. The box as claimed in claim 6, wherein two separate slots are defined in each inner flap, extending along the bottom edge of the corresponding sidewall.

9. The box as claimed in claim 8, wherein the slots adjoin the bottom edge of the corresponding sidewall and are disposed at opposite sides of the corresponding engaging groove.

10. The box as claimed in claim 9, wherein two tabs are formed on opposite lateral edges of each outer flap, and wherein the tabs are received into the adjacent slots.

11. The box as claimed in claim 6, wherein each engaging cutout divides the corresponding outer flap into two pieces which are respectively inserted into the engaging grooves of the inner flaps.

12. The box as claimed in claim 6, wherein the engaging grooves of the inner flaps are aligned with each other.

* * * * *